US006916020B2

(12) United States Patent
Hasegawa

(10) Patent No.: US 6,916,020 B2
(45) Date of Patent: Jul. 12, 2005

(54) SHEET SUPPLY APPARATUS AND SHEET HANDLING APPARATUS USING THE SAME

(75) Inventor: Yousuke Hasegawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 204 days.

(21) Appl. No.: 10/375,120

(22) Filed: Feb. 28, 2003

(65) Prior Publication Data

US 2003/0178764 A1 Sep. 25, 2003

(30) Foreign Application Priority Data

Mar. 19, 2002 (JP) ..... P2002-076805

(51) Int. Cl.[7] ..... B65H 1/00

(52) U.S. Cl. ..... 271/171; 271/223

(58) Field of Search ..... 271/145, 171, 271/223; 399/393; 211/50, 126.5, 126.6, 126.7

(56) References Cited

U.S. PATENT DOCUMENTS 5,172,903 A * 12/1992 Haneda et al. ..... 271/171
5,944,308 A * 8/1999 McLeod et al. ..... 271/171
6,056,286 A * 5/2000 Koga ..... 271/145

FOREIGN PATENT DOCUMENTS

JP 3-28145 U 3/1991
JP 2001-163454 6/2001

* cited by examiner

*Primary Examiner*—Donald P. Walsh
*Assistant Examiner*—Kaitlin Joerger
(74) *Attorney, Agent, or Firm*—Morgan, Lewis & Bockius LLP

(57) ABSTRACT

A sheet supply apparatus for supplying stacked sheets includes a standard sheet tray provided with a standard side guide that regulates a position in the width direction of the stacked sheet, and an extension sheet tray extendably disposed upstream of the standard sheet tray in a sheet feeding direction, wherein the extension sheet tray has an auxiliary side guide that regulates a position in the width direction of a sheet feeding direction upstream portion of a long sheet. A sheet handling apparatus using the sheet supply apparatus.

7 Claims, 10 Drawing Sheets

SHEET SUPPLY APPARATUS AND SHEET HANDLING APPARATUS USING THE SAME

BACKGROUND OF THE INVENTION

1. Field of the Invention

The present invention relates to a sheet supply apparatus which supplies a sheet, and particularly to improvements in a sheet supply apparatus available to supply a long sheet and in a sheet handling apparatus using the sheet supply apparatus.

2. Description of the Related Art

Generally, as a sheet handling apparatus, there is, for example, an electrophotographic type of image forming apparatus.

In this type of conventional image forming apparatus, an electrophotographic type of image forming engine is mounted in an apparatus body, an image is formed by the image forming engine, a sheet is supplied from a sheet supply apparatus to the image forming engine, the image formed by the image forming engine is transferred and fixed onto the sheet, and thereafter the sheet is exhausted to a sheet exhausting apparatus.

Here, there are various types of sheet supply apparatus such as a cassette type incorporated into an apparatus body or a manual type in which a sheet is manually supplied.

For example, as a manual type of sheet supply apparatus, a sheet supply apparatus has been already provided, in which one or plural steps of auxiliary trays is provided movably at a back end edge of a manual tray to secure a sheet placed surface on which even a rear end of a long sheet can be placed by the manual tray and the auxiliary tray, and the auxiliary tray is extendable for the longsheet (for example, refer to JP-A-2001-163454 and JP-UM-A-3-28145).

In this type of manual sheet supply apparatus, it is surely possible to secure the placed surface of the long sheet. However, a side guide for regulating a position in the width direction of the sheet is provided only for the manual tray, that is, only on a leading end side in the sheet feeding direction of the stacked long sheets, and the side guide is not provided on the auxiliary tray side.

Therefore, a position in the width direction on a sheet feeding direction rear end side of the long sheet is not regulated inevitably, and the stacked state of the long sheets on the manual tray and the auxiliary tray is unstable, so that there is fear that setting error of the long sheet or transporting failure (skew) of the long sheet accompanied by the setting error will be caused.

SUMMARY OF THE INVENTION

The invention has been made in order to solve the above technical problems, and an object of the invention is to provide a sheet supply apparatus and a sheet processing process using the sheet supply apparatus, in which setting performance and transportability of a long sheet can be kept good.

To achieve the above object, according to the present invention, there is provided a sheet supply apparatus for supplying a stacked sheet S as shown in FIGS. 1A and 1B. The sheet supply apparatus includes a standard sheet tray 1 provided with a standard side guide 2 that regulates a position in the width direction of the stacked sheet S, and an extension sheet tray 3 extendably provided on the upstream side in a sheet feeding direction of the standard sheet tray 1. The extension sheet tray 3 is provided with an auxiliary side guide 4 that regulates a position in the width direction of a sheet feeding direction upstream portion of the long sheet S.

This type of sheet supply apparatus 5, as shown in FIG. 1A, is provided for a sheet handling apparatus 10 for processing a sheet. As the type of sheet handling apparatus 10, there is an image forming apparatus, in which an image forming engine 12 is mounted in an apparatus body 11, an image formed by the image forming engine 12 is transferred and fixed onto a sheet S supplied from the sheet supply apparatus 5, and thereafter the sheet is exhausted to a sheet exhausting apparatus (sheet exhausting section) 6.

In such the technical means, the sheet supply apparatus 5, as long as it supplies the sheet S, includes various types such as a manual type and a cassette type.

Further, though the sheet supply apparatus of the invention includes the standard sheet tray 1, the standard sheet tray 1 requires the standard side guide 2.

It is because of the following reason: in case that the tray 1 does not have the standard side guide 2, even if a side position of sheet is regulated by the auxiliary side guide 4, there is fear that the side position of sheet shifts on the downstream side in the sheet feeding direction.

Further, the extension sheet tray 3 is provided extendably. Though it may be previously provided integrally with the standard sheet tray 1, in consideration of space reduction when normal sheets S other than the long sheet S are used, it is preferably extendable or detachable.

Regarding the extendable type, the extension sheet tray 3 is provided extendably for the standard sheet tray 1, all or a part of the extension sheet tray 3 can be housed in the standard sheet tray 1, and extension of the extension sheet tray 3 makes extension of the sheet tray.

On the other hand, regarding the detachable type, the extension sheet tray 3 is detachable in relation to the standard sheet tray 1, and the detachable type means that the extension sheet tray 3 is detachably attached to the standard sheet tray 1. Attachment of the extension sheet tray 3 makes extension of the sheet tray.

As a shape of the detachable extension sheet tray 3, various shapes such as a U-turn shape and a hanging shape may be appropriately selected.

Further, as a preferable mode of the auxiliary side guide 4, it is preferable that the auxiliary side guide 4 is foldable or detachable in relation to the extension sheet tray 3.

According to this mode, in case that the extension sheet tray 3 is the extendable type or the detachable type, the existence of the auxiliary side guide 4 is not obstructive.

Further, it is preferable that the auxiliary side guide 4 is movable in the sheet feeding direction. According to this mode, the position of the auxiliary side guide 4 can be set variably in accordance with a size of the long sheet S.

Furthermore, there may be plural positions in the sheet feeding direction at which the auxiliary side guide 4 can be arranged. In this case, by setting the plural arrangement positions, the position of the auxiliary side guide 4 can be set in accordance with a size of the long sheet S.

Further, the invention is not limited to the sheet supply apparatus but it is applied also to a sheet handling apparatus using the sheet supply apparatus.

In this case, the invention is a sheet handling apparatus that performs the predetermined processing on the long sheet S supplied from the sheet supply apparatus 5, and the sheet handling apparatus uses the above-mentioned sheet supply apparatus as a sheet supply apparatus 5.

BRIEF DESCRIPTION OF THE DRAWINGS

These and other objects and advantages of this invention will become more fully apparent from the following detailed description taken with the accompanying drawings in which.

DETAILED DESCRIPTION OF THE PREFERRED EMBODIMENTS

The invention will be described below in detail with reference to attached drawings.

Embodiment 1

Figure 1A:
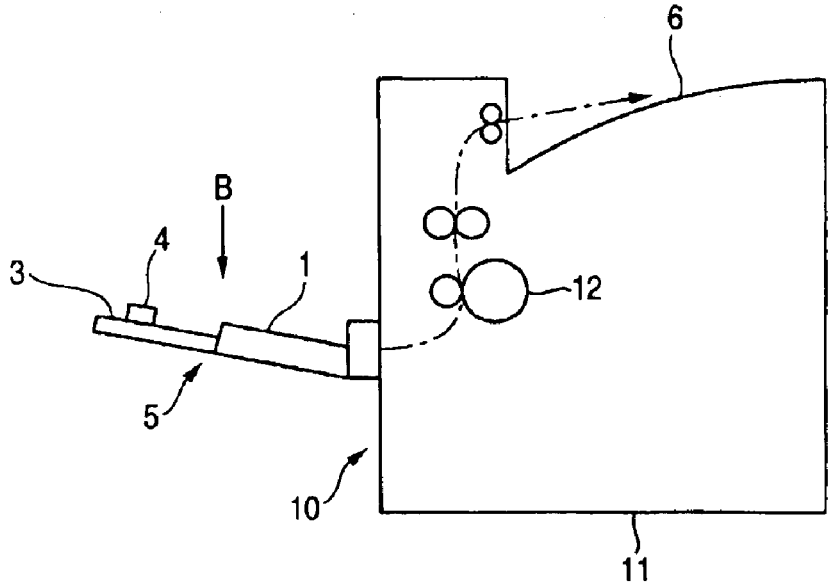
FIG. 1A is an explanatory view showing an outline of a sheet supply apparatus according to the invention and of a sheet handling apparatus using the sheet supply apparatus.
Figure 1B:
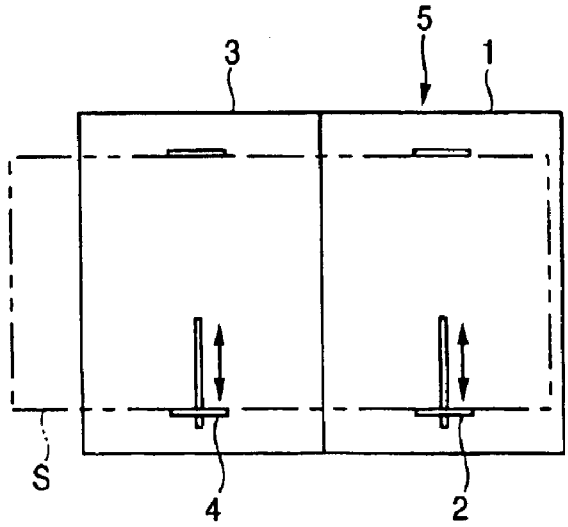
FIG. 1B is a view taken along an arrow B in FIG. 1A.
Figure 2:
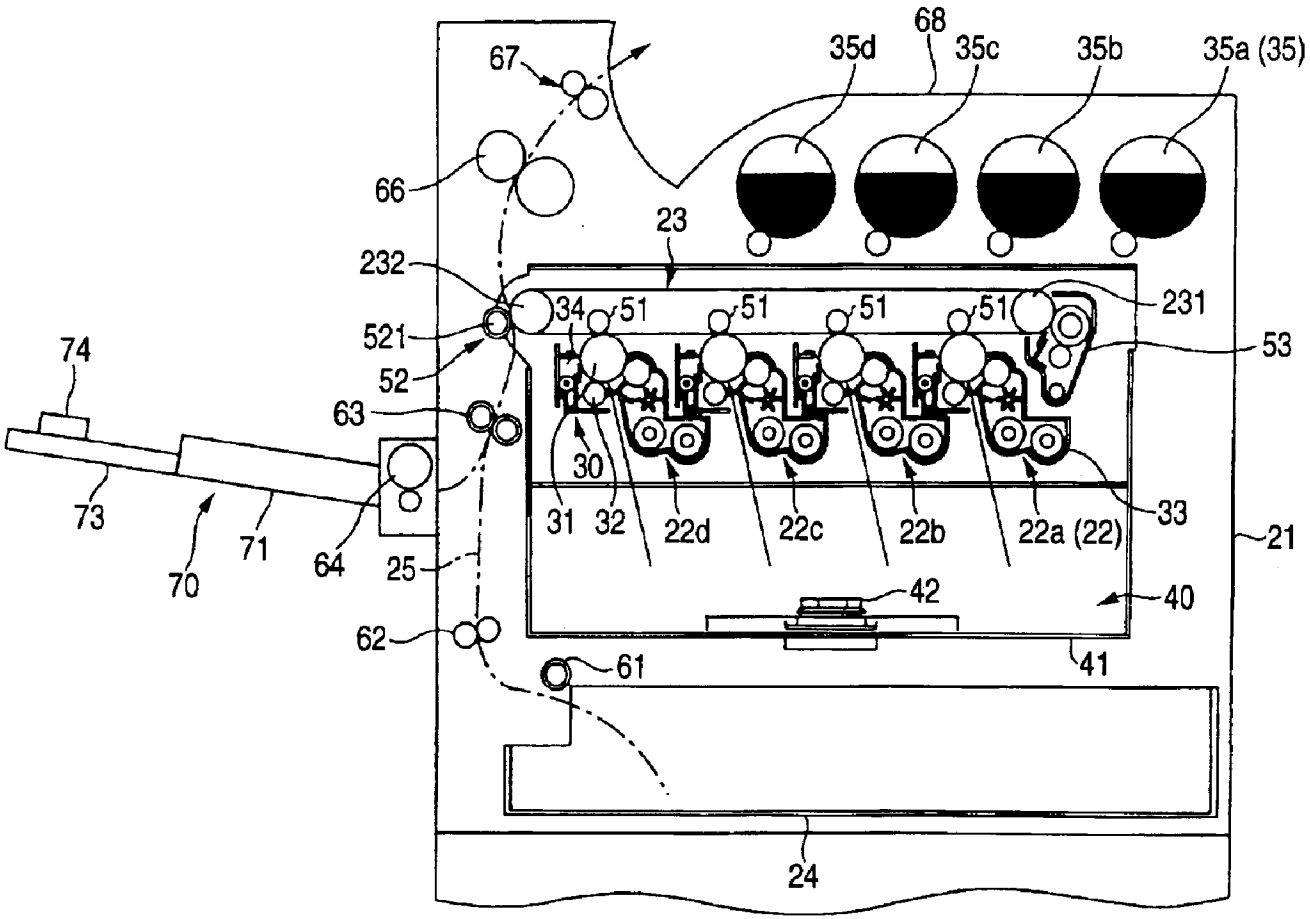
FIG. 2 is an explanatory view showing the whole constitution of an image forming apparatus as a sheet handling apparatus according to a first embodiment.

FIG. 2 is an explanatory diagram showing a first embodiment of a tandem type image forming apparatus as a sheet handling apparatus to which the invention is applied.

In the figure, in the tandem type image forming apparatus, image forming units 22 (specifically, 22*a* to 22*d*) for four colors (black, yellow, magenta, and cyan in this embodiment) are arranged into a body housing 21 in transverse direction, and an intermediate transfer belt 23 transported circularly along the arrangement direction of each image forming unit 22 is provided at a upward portion of the units 22. On the other hand, a sheet supply cassette 24 having predetermined steps into which sheets (not shown) are stored is provided at a downward portion of the body housing 21, and a sheet transporting path extending from the sheet supply cassette 24 is arranged in the approximately perpendicular direction.

In the embodiment, each image forming unit 22 (22*a* to 22*d*) forms a toner image in the order of for black, for yellow, for magenta, and for cyan from the upstream side in the circular direction of the intermediate transfer belt 23 (Arrangement is not always limited to this order.). Further, each image forming unit 22 includes each photoconductor unit 30, each developing unit 33, and a common exposure unit 40.

Here, the photoconductive unit 30 is constituted by forming integrally a photoconductor drum 31, a charger (a charging roll in this example) 32 previously charging the photoconductor drum 31, and a cleaner 34 for removing the residual toner on the photoconductor drum 31 into a cartridge, and it constitutes a so-called CPU (Customer Replaceable Unit).

Further, the developing unit 33 develops an electrostatic latent image exposure-formed on the charged photoconductor drum 31 by the exposure unit 40 with the corresponding color toner (having negative polarity in this embodiment).

Reference numeral 35 (35*a* to 35*d*) is a toner cartridge for supplying toner of each color component to each developing unit 33 (a toner supplying passage is not shown).

On the other hand, the exposure unit 40 stores in a unit case 41 four semiconductive lasers (not shown), a polygon mirror 42, an image forming lens (not shown) and mirrors corresponding to the respective photoconductor units 30 (not shown), wherein light from the semiconductive laser of each color component is deflection-scanned by the polygon mirror 42, and a light image is guided through the image forming lens and the mirror onto an exposure point on the corresponding photoconductor drum 31.

Further, in the embodiment, the intermediate transfer belt 23 is laid between a pair of tension rolls 231 and 232 (one of them is a driving roll). On the back surface of the intermediate transfer belt 23 corresponding to the photoconductor drum 31 of each photoconductor unit 30, a primary transfer unit (primary transfer roll in this example) 51 is provided. By applying a voltage of opposite polarity to the charging polarity of the toner to the primary transfer unit 51, a toner image on the photoconductor drum 31 is electrostatically transferred onto the intermediate transfer belt 23.

Further, at a portion of the intermediate transfer belt corresponding to the tension roll 232 located on the downstream side of the most downstream image forming unit 22*d*, a secondary transfer unit 52 is provided to secondarily transfer (transfer in the lump) primarily transferred images on the intermediate transfer belt 23 onto a sheet.

In the embodiment, the secondary transfer unit 52 includes a primary transfer roll 521 arranged so as to come into pressure contact with the toner image carrying surface side of the intermediate transfer belt 23, and a back up roll (the tension roll 232 is used as a back up roll in this embodiment) arranged on the back side of the intermediate transfer belt 23 and provides an opposite electrode of the primary transfer roll 521.

For example, the primary transfer roll 521 is grounded, and a bias of the same polarity as the charging polarity of the toner is applied to the back up roll (tension roll 232).

Furthermore, a belt cleaner 53 is arranged on the upstream side of the most upstream image forming unit 22*a* of the intermediate transfer belt 23 to remove the residual toner on the intermediate transfer belt 23.

Further, for the sheet supply cassette 24, a feed roll 61 that picks up a sheet is provided. Immediately at the back of the feed roll 61, a take away roll 62 feeding out the sheet is arranged, and a registration (registration roll) 63 that supplies a recording medium at the predetermined timing to the secondary transfer section is arranged on the sheet transporting passage 25 located immediately before the secondary transfer section.

On the other hand, a fixing apparatus 66 is provided on the sheet transporting passage 25 located on the downstream side of the secondary transfer section, a sheet exhausting roll 67 is provided on the downstream side of the fixing unit 66, and an exhausting tray 68 as an sheet exhausting apparatus is formed on the upper portion of the body housing 21, into which the exhausted sheet is stored.

Further, in the embodiment, on a side of the body housing 21, a manual type sheet supply apparatus (MSI) 70 is provided, and a sheet on the manual type sheet supply apparatus 70 is fed out by a feed roll 64 toward a portion of the sheet transporting passage 25 located immediately before the registration roll 63.

Figure 3:
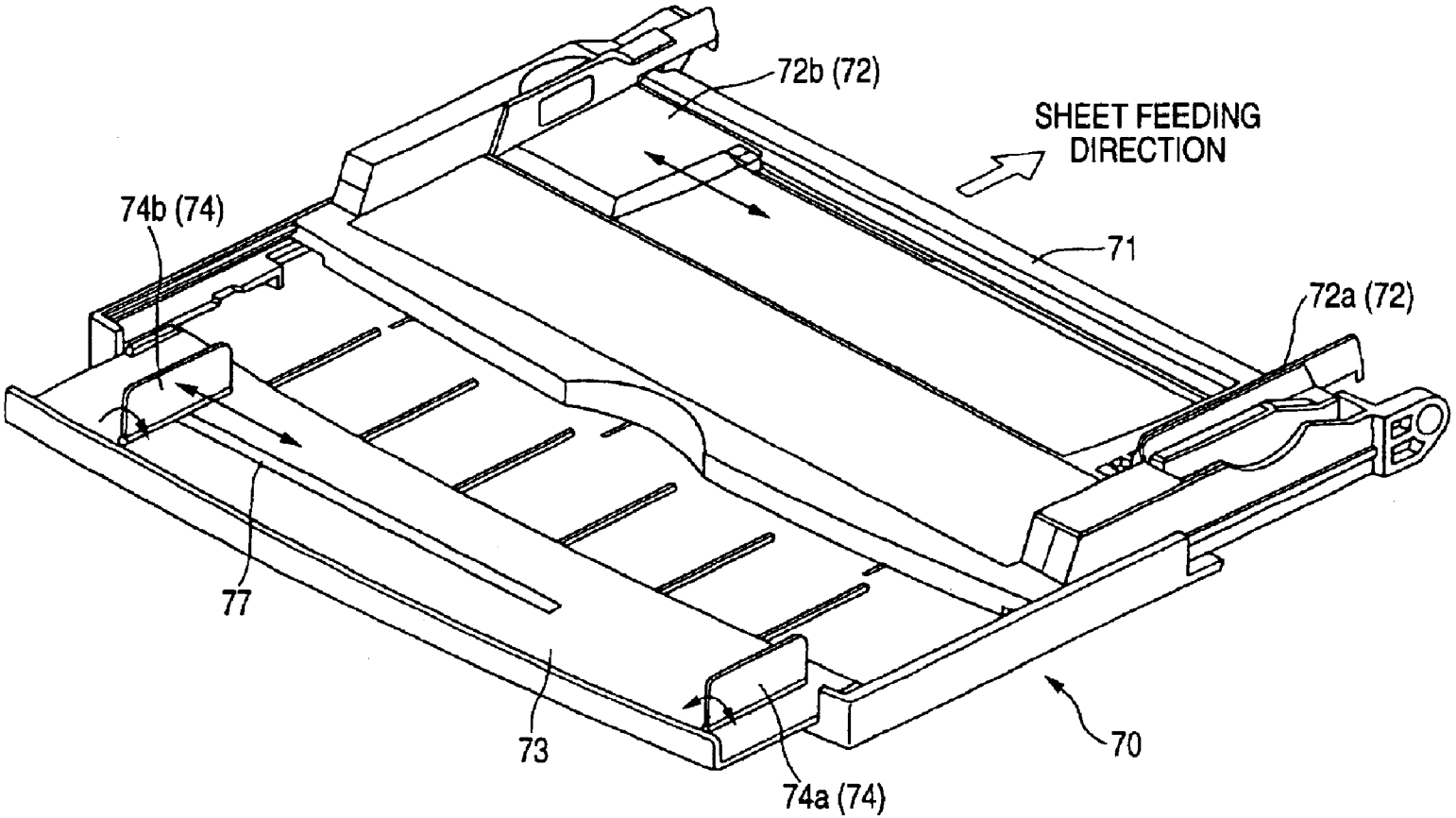
FIG. 3 is a perspective view showing a manual type sheet supply apparatus according to the embodiment.

Particularly, in the embodiment, the manual type sheet supply apparatus 70, as shown in FIGS. 2 and 3, comprises a standard sheet tray 71, a standard side guide 72 provided on the standard sheet tray 71 and regulates a position in the width direction of the stacked sheet, an extension sheet tray 73 provided extendably on the upstream side in the sheet feeding direction of the standard sheet tray 71, and an auxiliary side guide 74 provided on the extension sheet tray 73 and regulates a position in the width direction of the stacked sheet.

In the embodiment, the standard side guide 72, as shown in FIG. 3, comprises a fixed side guide 72*a* and a movable side guide 72*b* that can move in the width direction of sheet, and regulates both side positions on a leading end side in a feeding direction of a long sheet.

Figure 4:
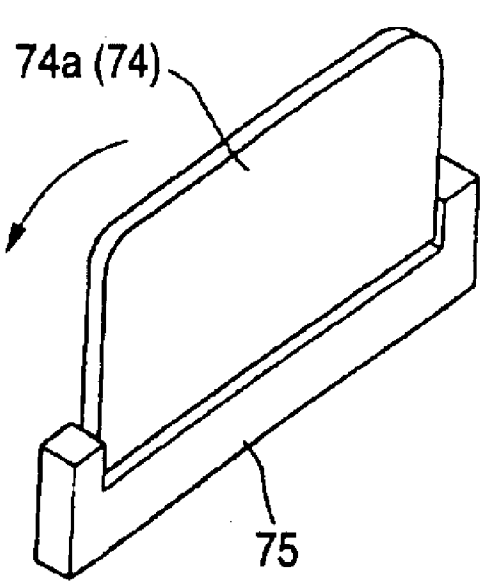
FIG. 4 is an explanatory view showing the supporting structure of an auxiliary side guide.
Figure 4:
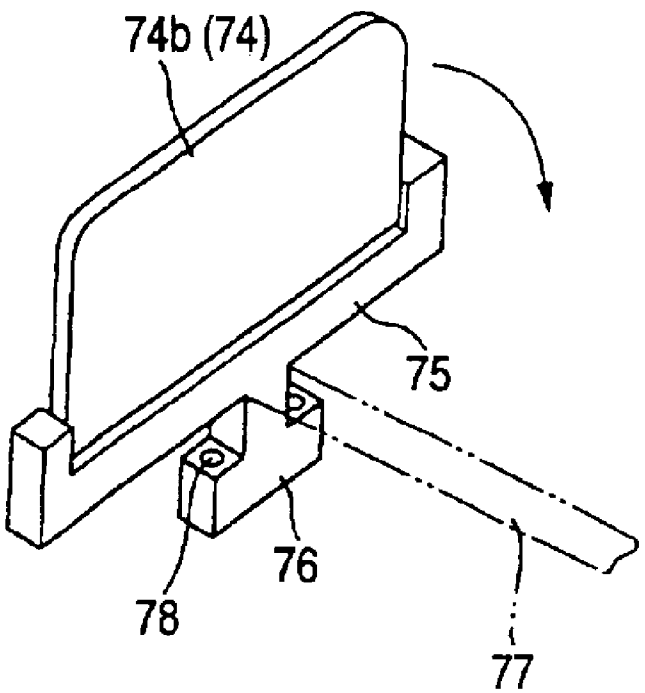

On the other hand, the auxiliary side guide 74, as shown in FIGS. 3 and 4, comprises a fixed side guide 74*a* and a movable side guide 74*b* that can move in the width direction of sheet, and regulates both side positions on a rear end side in a feeding direction of a long sheet.

In the embodiment, any auxiliary side guide 74 is foldable in the predetermined direction in relation to a support holder 75. For example, the support holder 75 of the fixed side guide 74*a* is fixed to the extension sheet tray 73, while the support holder 75 of the movable side guide 74*b* is provided with a reverse T-shaped guide shoe 76 and the guide shoe 76 is slidably attached to a guide slit 77 formed in the extension sheet tray 73. Reference numeral 78 is a holding spring for providing elastic holding between the guide shoe 76 and the guide slit 77.

Figure 5:
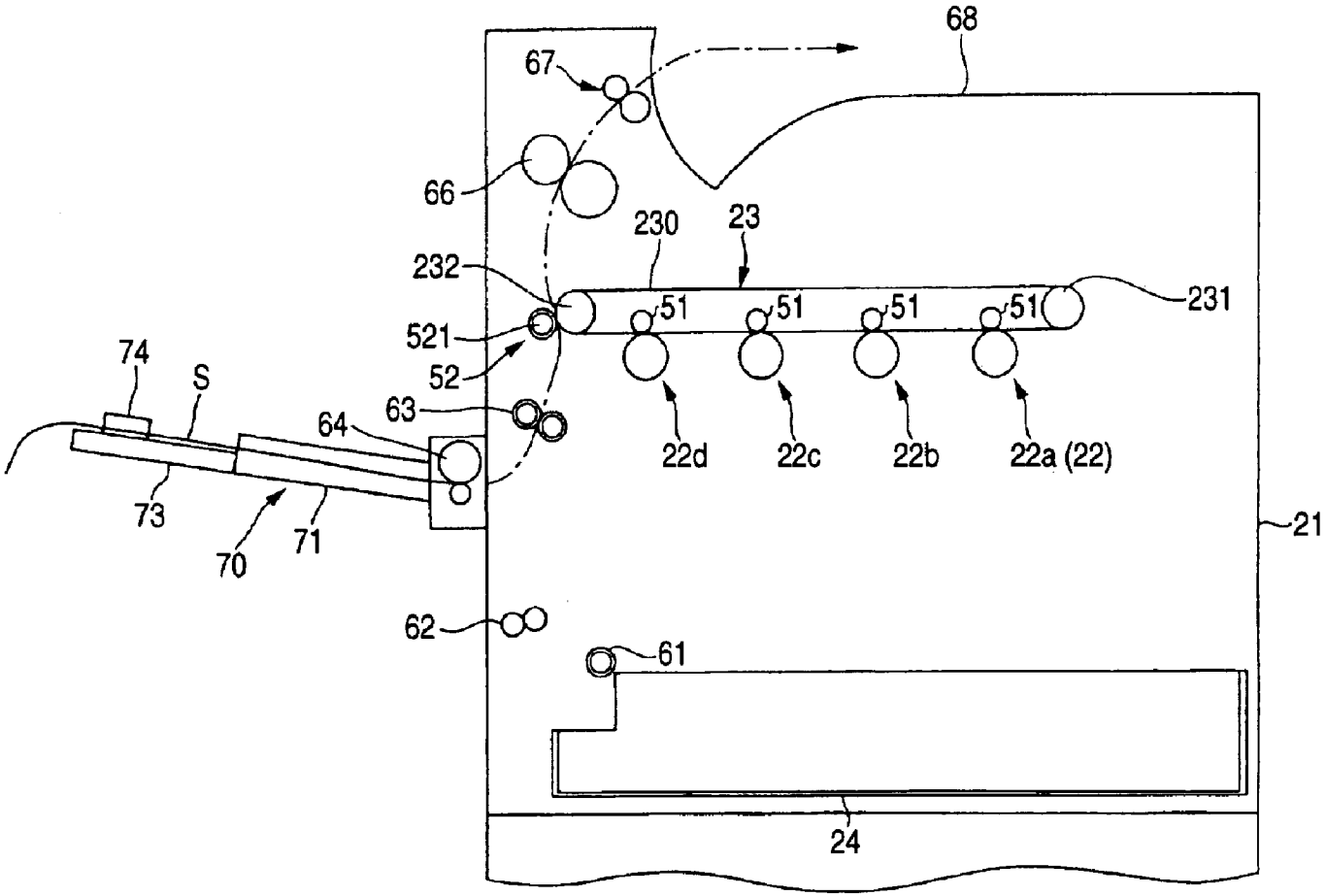
FIG. 5 is an explanatory view showing a sheet transporting state of the sheet handling apparatus according to the first embodiment.

Consequently, according to the embodiment, in case that a long sheet S is stacked on the manual type sheet supply apparatus 70, as shown in FIGS. 3 and 5, after the extension sheet tray 73 is extended from the standard sheet tray 71, the auxiliary side guide 74 on the extension sheet tray 73 is erected from the folded state. Thereafter, the long sheet S is stacked on the extended sheet tray 71, 73, and the front and back both side positions of the long sheet S are regulated by the standard side guide 72 and the auxiliary side guide 74.

Under this state, the long sheet S stacked on the manual type sheet supply apparatus 70 is exactly positioned by each side guide 72, 74 and set on the sheet tray 71, 73.

Therefore, the long sheet S supplied from the manual type sheet supply apparatus 70, as shown in FIG. 5, is fed through the registration roll 63 on the sheet transporting passage 25 to the secondary transfer section. After the long sheet S receives at the primary transfer section secondary transfer of the image primarily transferred on the intermediate transfer belt 23, it is exhausted through the fixing apparatus 66 and the sheet exhausting roll 67 onto the exhausting tray 68.

In such the transporting process, the supply state of the long sheet S is very stable. Therefore, transporting failure such as skew of the long sheet S is not caused, and quality of image on the long sheet S is kept good.

Embodiment 2

Figure 6:
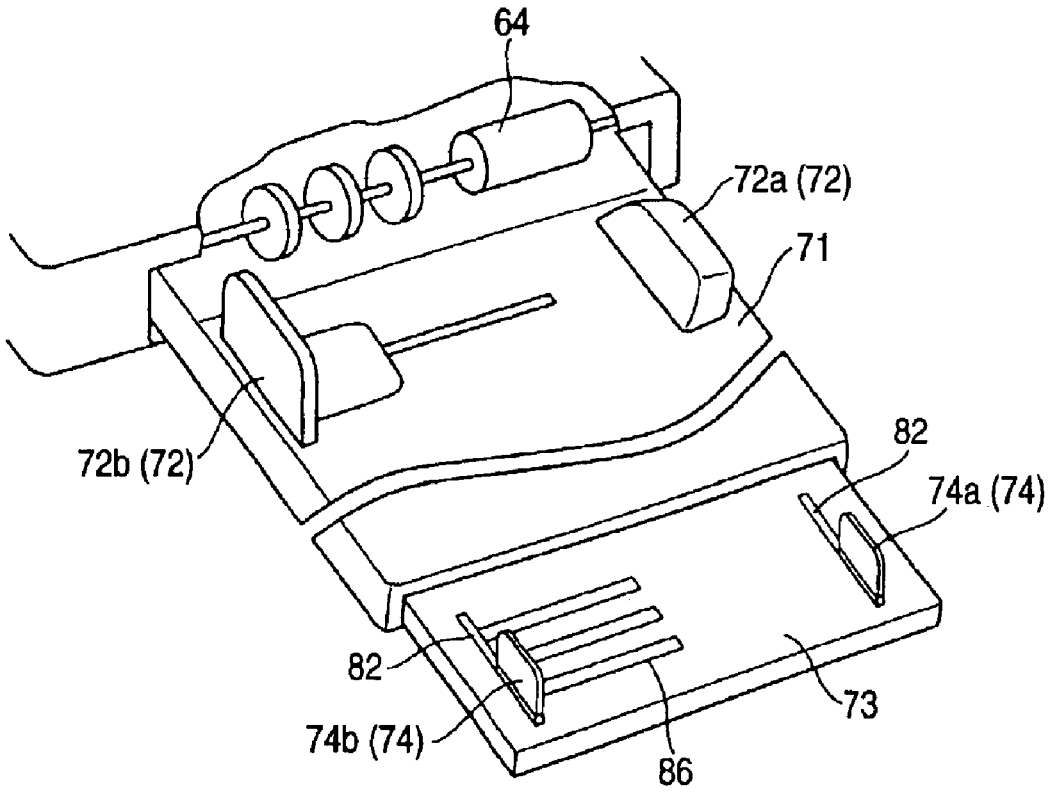
FIG. 6 is an explanatory view showing a manual type sheet supply apparatus according to a second embodiment.

FIG. 6 shows a second embodiment of a manual type sheet supply apparatus.

In the figure, though the basic constitution of the manual type sheet supply apparatus is approximately the same as that in the first embodiment, it is different in that an auxiliary side guide 74 (fixed side guide 74*a*, movable side guide 74*b*) is movable in the sheet feeding direction.

Figure 7A:
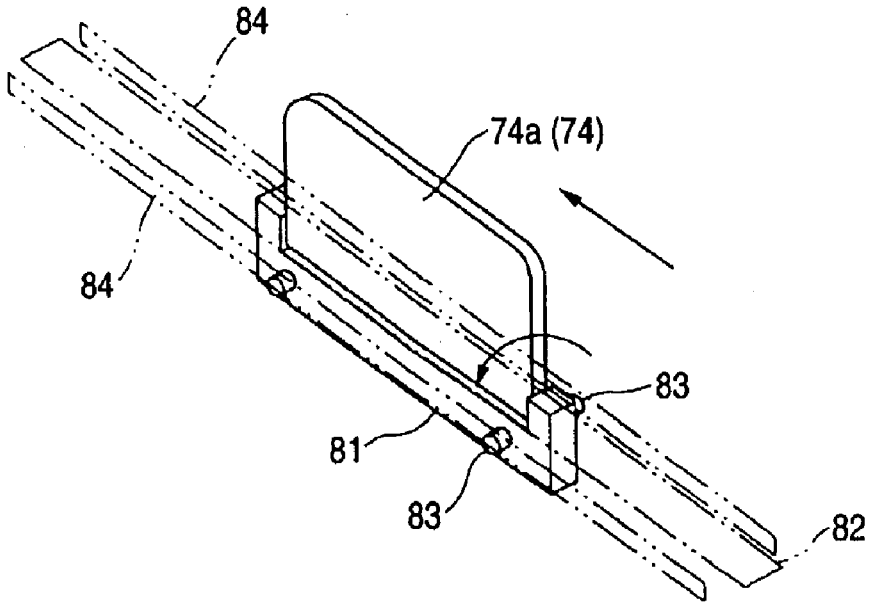
FIGS. 7A and 7B are explanatory views showing the supporting structure of an auxiliary side guide according to the second embodiment.

For example, regarding the supporting structure of a fixed side guide 74*a* of which a side position is fixed, of the auxiliary side guide 74, as shown in FIG. 7A, the fixed side guide 74*a* is foldably supported by a support holder 81, the support holder 81 is provided movably along a feeding direction guide slit 82 extending in the sheet feeding direction, and the predetermined number of fitting pins 83 are projected and formed at the support holder 81. In an inner wall of the feeding direction guide slit 82, a fitting groove 84 into which the fitting pin 83 is slidably fit is formed, and the fixed side guide 74*a* can move along the feeding direction guide slit 82.

Figure 7B:
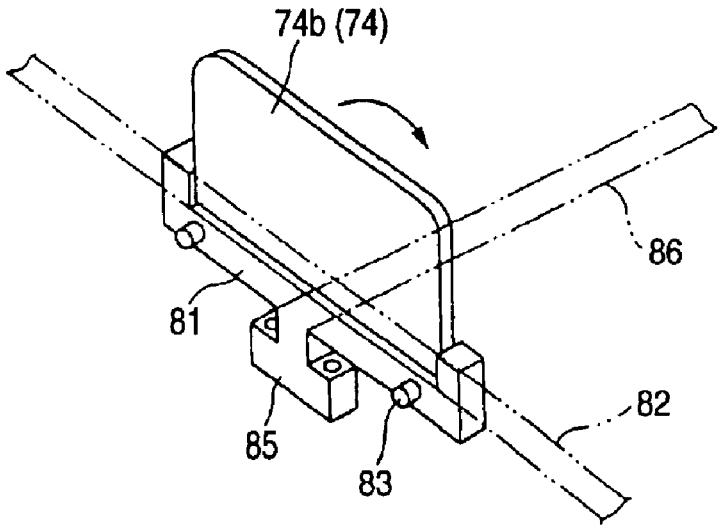

Further, regarding the supporting structure of a movable side guide 74*b* by which a side position can be moved, as shown in FIG. 7B, the movable side guide 74*b* is supported foldably by a support holder 81, and the support holder 81 is slidably fitted into a feeding direction guide slit 82 (a fitting groove is not shown) formed in an extension sheet tray 73. On the other hand, a guide shoe 85 is further formed at the support holder 81, and it is slidably fitted into any of the predetermined number (three in this embodiment) of width direction guide slits 86 formed in the extension sheet tray 73 and extending in the width direction, whereby the movable side guide 74*b* can move along the feeding direction guide 82 and the width direction guide slit 86.

Therefore, according to the embodiment, since the auxiliary side guide 74 is constituted movably in the sheet feeding direction, it can be moved and set in the optimum position according to a size of a long sheet, so that the sheet supply apparatus can correspond to long sheets of various sizes, compared with that in the first embodiment.

Embodiment 3

Figure 8:
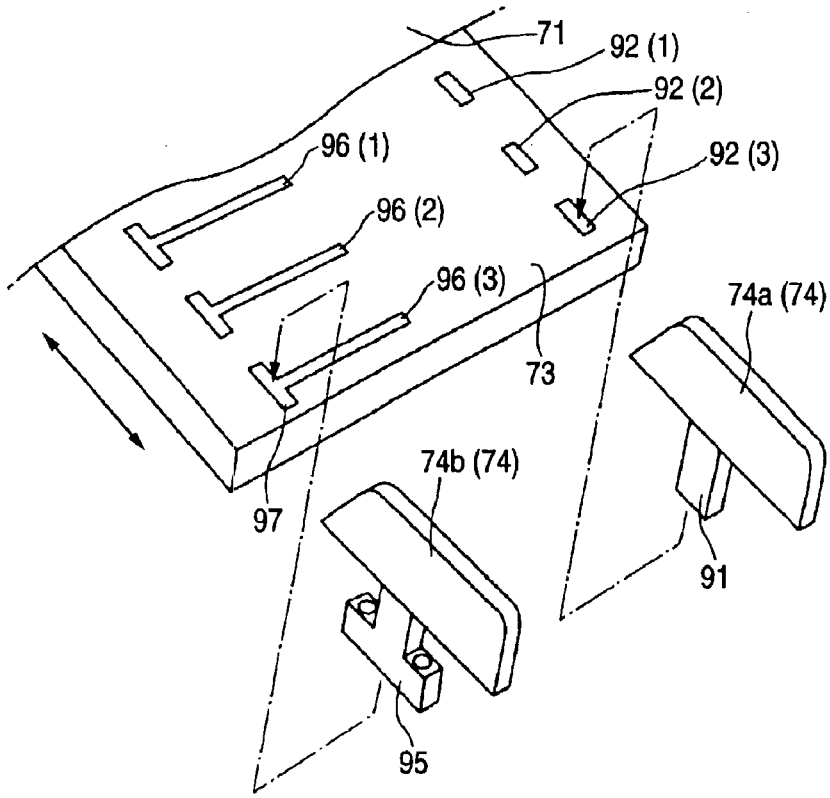
FIG. 8 is an explanatory view showing a main portion of a manual type sheet supply apparatus according to a third embodiment.

FIG. 8 shows a third embodiment of a manual type sheet supply apparatus.

In the figure, though the basic constitution of the manual type sheet supply apparatus is approximately the same as that in the second embodiment, it is different in that there are plural positions in the sheet feeding direction at which an auxiliary side guide 74 (fixed side guide 74*a*, movable side guide 74*b*) can be arranged.

Namely, in the embodiment, regarding the supporting structure of a fixed side guide 74*a* of the auxiliary side guide 74, a fitting projection 91 extending downward is formed at a lower end of a fixed side guide 74*a*, while plural (three in this embodiment) fitting holes 92 (specifically, 92(1) to 92(3)) are formed in an extension sheet tray 73 in the sheet feeding direction, and the fixed side guide 74 can be arbitrarily fitted into any of the fitting holes 92.

On the other hand, regarding the supporting structure of a movable side guide 74*b*, a reverse T-shaped guide shoe 95 is formed at a lower end of the movable side guide 74*b*, while plural (three in this embodiment) guide slits 96 (specifically, 96(1) to 96(3)) are in parallel formed in an extension sheet tray 73 in the sheet feeding direction, and the movable side guide 74*b* can be arbitrarily fitted into any of the guide slits 96. Further, at one end of the guide slit 96, an insertion groove 97 for the guide shoe 95 is formed.

Consequently, according to the embodiment, since there are plural positions in the sheet feeding direction at which the auxiliary side guide 74 can be arranged, the auxiliary side guide 74 can be selected and set at an optimum position according to a size of a long sheet, so that the sheet supply apparatus can correspond to long sheets of various sizes similarly to in the second embodiment.

Further, plural sets of auxiliary side guides 74 may be provided. In this case, in order to facilitate registration, it is good to cooperate the plural sets of auxiliary side guides 74 by a cooperating mechanism (not shown).

Embodiment 4

Figure 9:
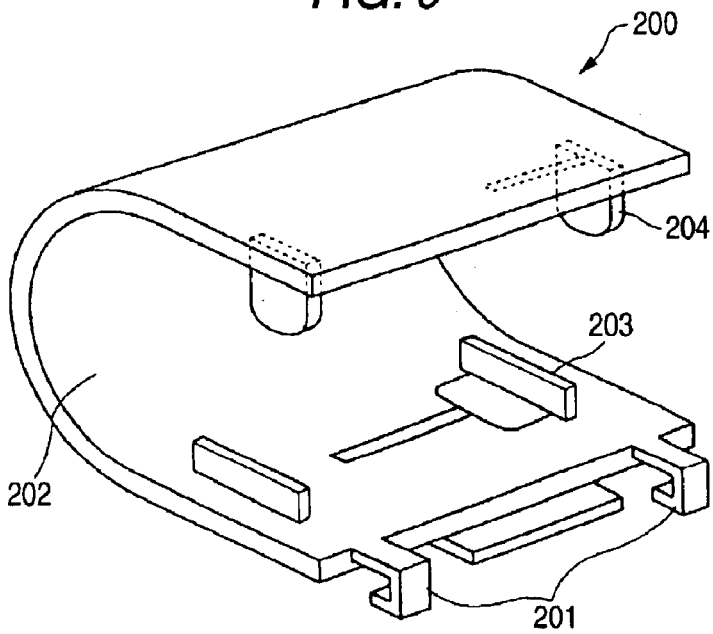
FIG. 9 is an explanatory view showing a main portion of a manual type sheet supply apparatus according to a fourth embodiment.

FIG. 9 shows a main portion in a fourth embodiment of a manual type sheet supply apparatus.

The manual type sheet supply apparatus according to this embodiment has an extension sheet tray 200 that is different from the extension sheet trays in the first to third embodiments.

The extension sheet tray 200 includes joint pieces 201 detachably joined to a rear end of a standard sheet tray 71 (refer to FIG. 3), and an approximately U-turn shaped sheet placed surface 202. At upper and lower portions of the sheet placing surface 202, each auxiliary side guide 203,204 is provided.

Consequently, according to this embodiment, in case that a long sheet is supplied, the extension sheet tray 200 is attached to the standard sheet tray 71.

At this time, a rear end portion of the long sheet, in a state where it is stuck onto the U-turn shaped sheet placed surface of the extension sheet tray 200, is exactly position-regulated by the auxiliary side guides 203 and 204.

On the other hand, in case that the long sheet is not used, the extension sheet tray 200 is detached from the standard sheet tray 71.

Embodiment 5

Figure 10A:
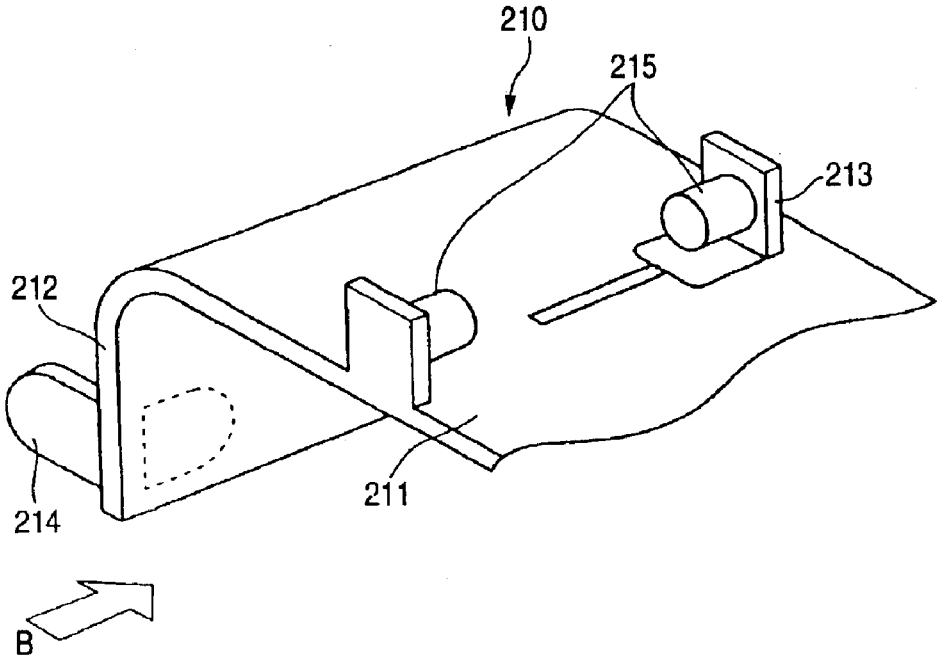
FIG. 10A is an explanatory view showing a main portion of a manual type sheet supply apparatus according to a fifth embodiment.
Figure 10B:
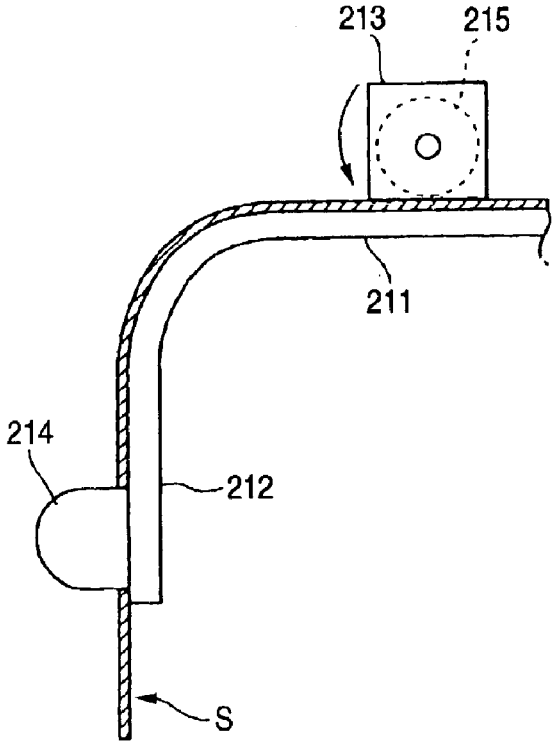
FIG. 10B is a view taken along an arrow B in FIG. 10A.

FIGS. 10A and 10B show main portions in a fifth embodiment of a manual type sheet supply apparatus.

The manual type sheet supply apparatus according to this embodiment has an extension sheet tray 210 that is different from the extension sheet trays in the first to fourth embodiments.

The extension sheet tray 210 includes joint pieces detachably joined to a rear end of a standard sheet tray 71 (refer to FIG. 3), and a hanging portion 212 that is hung downward gradually from a horizontal portion 211. Further, auxiliary side guides 213 and 214 are provided respectively for the horizontal portion 211 and the hanging portion 212, and a press roll 215 including one-way clutch is arranged at the auxiliary side guide 213 of the horizontal portion 211 to press a long sheet so as to prevent a fall of the long sheet.

Consequently, according to this embodiment, in case that a long sheet is supplied, the extension sheet tray 210 is attached to the standard sheet tray 71.

At this time, though a rear end of the long sheet is hung from the horizontal portion 211 of the extension sheet tray 210 to the hanging portion 212, it is held by the pressing operation of the press roll 215 without falling. Further, the long sheet is exactly position-regulated by the auxiliary side guides 213 and 214.

On the other hand, in case that the long sheet is not used, the extension sheet tray 210 is detached from the standard sheet tray 71.

Embodiment 6

Figure 11:
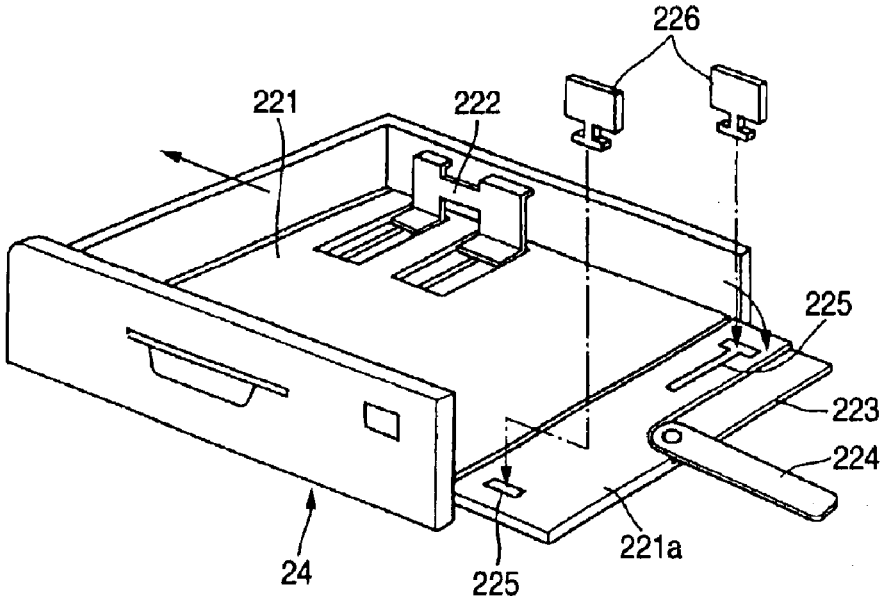
FIG. 11 is an explanatory view showing a cassette type sheet supply apparatus according to a sixth embodiment.

FIG. 11 shows a sixth embodiment of a cassette type sheet supply apparatus.

This embodiment is different from the first to five embodiments in that the invention is applied to a cassette type sheet supply apparatus.

A cassette type sheet supply apparatus 24 according to the embodiment (corresponding to the sheet supply cassette 24 in FIG. 2) includes a cassette body 221 as a standard sheet tray, and a standard side guide 222 in the cassette body 221. On the other, a wall portion 221*a* on the opposite side to the sheet feeding direction of the cassette body 221 is constituted so that it can get up and fall down, fall-down of the wall portion 221*a* causes it to function as an extension sheet tray 223, and a rotatable back support bar 224 is provided for the extension sheet tray 223 thereby to increase a rear end support portion of a long sheet.

Further, in this embodiment, in the cassette type sheet supply apparatus 24, guide attaching portions 225 (fitting groove and guide slit) are formed inside the wall portion 221*a*, whereby auxiliary side guides 226 are detachably attached to the guide attaching portions 225.

Consequently, according to the embodiment, in case that a long sheet is used, a using mode of the cassette type sheet supply apparatus 24 is changed to a long sheet using mode, the long sheet is stacked on the extension sheet tray 223 comprising the wall portion 221*a* falling down from the cassette body 221 and a back support bar 224, and the long sheet is position-regulated by the standard side guide 222 and the auxiliary side guides 226.

In this state, since the long sheet is exactly set without skewing, the transporting failure is seldom produced in the supplied long sheet.

Modification

Figure 12:
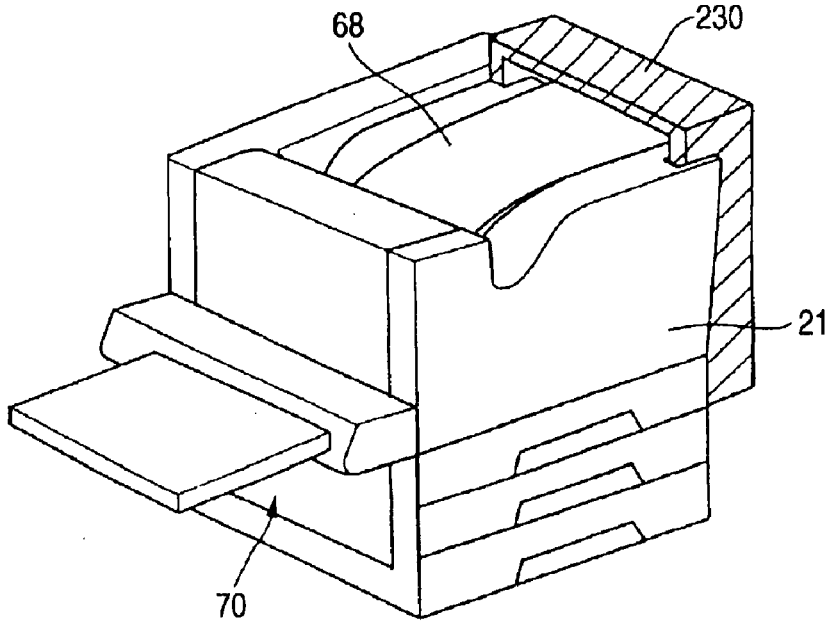
FIG. 12 is an explanatory view showing a modification of a sheet exhausting apparatus used in the sheet handling apparatus.

In the first to sixth embodiments, the exhausting tray 68 is used in an intact state as the sheet exhausting apparatus. However, from a viewpoint of keeping exhaust and accommodation of the long sheet good, as shown in FIG. 12, an exhaust accommodating unit 230 maybe provided adjacently to the exhaust tray 68 to improve the exhaust and accommodation of the long sheet by the exhaust tray 68 and the exhaust accommodating unit 230, or a dedicated exhaust accommodating unit (not shown) may be detachably attached without using the exhaust tray 68 to exhaust and accommodate the long sheet into the exhaust tray 68.

As described above, according to the invention, an extension sheet tray is provided on the upstream side in the sheet feeding direction of a standard sheet tray having a standard side guide, and the extension sheet tray is provided with an auxiliary side guide. Hereby, in case that a long sheet is stacked on the sheet tray, the front and back of the long sheet can be surely position-regulated by the side guides.

Therefore, the stacked state of the long sheet can be stabilized, so that a setting error of long sheet and transporting failure accompanied by the setting error can be surely avoided.

Further, according a sheet handling apparatus using the above sheet supply apparatus, the transportability of the supplied long sheet can be always kept good. Hereby, lowering of handling quality caused by the transporting failure of the long sheet can be surely avoided, so that the handling quality on the long sheet can be always kept stable.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A sheet supply apparatus for supplying stacked sheets, comprising:

a standard sheet tray including a standard side guide that regulates a position in the widthwise direction of the stacked sheet; and an extension sheet tray extendably disposed upstream of the standard sheet in a sheet feeding direction of the standard sheet tray, wherein the extension sheet tray includes an auxiliary side guide that regulates a position in the widthwise direction of a sheet feeding direction upstream portion of a long sheet, and the auxiliary side guide is movable in relation to the extension sheet tray.

2. The sheet supply apparatus according to claim 1, wherein the extension sheet tray is extendable in relation to the standard sheet tray.

3. The sheet supply apparatus according to claim 1, wherein the extension sheet tray is detachably attached on the standard sheet tray.

4. A sheet supply apparatus for supplying stacked sheets, comprising:

a standard sheet tray including a standard side guide that regulates a position in the widthwise direction of the stacked sheet; and an extension sheet tray extendably disposed upstream of the standard sheet in a sheet feeding direction of the standard sheet tray, wherein the extension sheet tray includes an auxiliary side guide that regulates a position in the widthwise direction of a sheet feeding direction upstream portion of a long sheet, wherein the auxiliary side guide is foldable or detachable in relation to the extension sheet tray.

5. The sheet supply apparatus according to claim 1, wherein the auxiliary side guide is movable in the sheet feeding direction.

6. A sheet supply apparatus for supplying stacked sheets, comprising:

a standard sheet tray including a standard side guide that regulates a position in the widthwise direction of the stacked sheet; and an extension sheet tray extendably disposed upstream of the standard sheet in a sheet feeding direction of the standard sheet tray, wherein the extension sheet tray includes an auxiliary side guide that regulates a position in the widthwise direction of a sheet feeding direction upstream portion of a longsheet, wherein the auxiliary side guide is arranged at plural positions in the sheet feeding direction.

7. A sheet handling apparatus for performing predetermined processing on a long sheet supplied from a sheet supply apparatus, the sheet supply apparatus comprising;

a standard sheet tray including a standard side guide that regulates a position in the widthwise direction of the stacked sheet; and an extension sheet tray extendably disposed upstream of the standard sheet in a sheet feeding direction of the standard sheet tray, wherein the extension sheet tray includes an auxiliary side guide that regulates a position in the widthwise direction of a sheet feeding direction upstream portion of a long sheet, and the auxiliary side guide is movable in relation to the extension sheet tray.

* * * * *